United States Patent [19]

Kanagaki et al.

[11] Patent Number: 4,957,243

[45] Date of Patent: Sep. 18, 1990

[54] SHREDDER

[75] Inventors: Toshikuni Kanagaki, Nara; Minoru Hashimoto, Yamatokoriyama; Shougo Iwai, Yamatokoriyama; Masaru Nishijima, Hirakata, all of Japan

[73] Assignee: Sharp Kabushiki Kaisha, Osaka, Japan

[21] Appl. No.: 403,897

[22] Filed: Sep. 5, 1989

Related U.S. Application Data

[63] Continuation of Ser. No. 271,377, Nov. 14, 1988, abandoned, which is a continuation of Ser. No. 047,285, May 8, 1987, abandoned.

[30] Foreign Application Priority Data

| | | | |
|---|---|---|---|
| May 8, 1986 | [JP] | Japan | 61-105878 |
| Oct. 2, 1986 | [JP] | Japan | 61-235980 |
| Oct. 2, 1986 | [JP] | Japan | 61-235981 |
| Oct. 2, 1986 | [JP] | Japan | 61-235982 |
| Oct. 2, 1986 | [JP] | Japan | 61-235983 |

[51] Int. Cl.[5] ..... B02C 25/00

[52] U.S. Cl. ..... 241/34; 241/236; 271/9; 271/110

[58] Field of Search ..... 241/33, 34, 223, 236; 271/9, 110

[56] References Cited

U.S. PATENT DOCUMENTS

| | | | |
|---|---|---|---|
| 4,192,467 | 3/1980 | Hatanaka | 241/222 X |
| 4,386,769 | 6/1983 | Ito et al. . | |
| 4,484,734 | 11/1984 | Tsudaka et al. | 271/9 |
| 4,530,494 | 7/1985 | Saitoh et al. | 271/9 |
| 4,763,889 | 8/1988 | Dei et al. | 271/9 |

FOREIGN PATENT DOCUMENTS

| | | | |
|---|---|---|---|
| 2214800 | 9/1973 | Fed. Rep. of Germany | 241/236 |
| 2645284 | 4/1978 | Fed. Rep. of Germany . | |
| 2382937 | 11/1978 | France | 241/236 |
| 2394326 | 2/1979 | France | 241/236 |
| 2034199 | 6/1980 | United Kingdom | 241/236 |

*Primary Examiner*—Joseph M. Gorski

*Attorney, Agent, or Firm*—Birch, Stewart, Kolasch & Birch

[57] ABSTRACT

A shredder for feeding documents from a document loading portion to a document shredding portion so as to shred the documents by the document shredding portion, in which the document loading portion is constituted by a plurality of document loading apertures such that a total quantity of the documents capable of being fed from the document loading apertures to the document shredding portion is so set as to be not more than a shredding capability of the document shredding portion.

3 Claims, 10 Drawing Sheets

SHREDDER

This application is a continuation of application Ser. No. 271,377 filed on 11/14/88, which is a continuation of Ser. No. 047,685, filed on May 8, 1987, both now abandoned.

BACKGROUND OF THE INVENTION

The present invention relates to a shredder for shredding documents or the like.

Documents or the like bearing confidential matters are, after their utilization, shredded so as to make the contents of the documents or the like illegible so that disclosure of the contents of the documents or the like is prevented.

Conventionally, in order to shred documents or the like, apparatuses have been employed in which the documents or the like bearing confidential matters are fed in between upper and lower rotating cutters from a document loading aperture so as to be shredded into pieces by the upper and lower rotating cutters. If another person, other than the operator wishes, while the operator is continuously shredding a large quantity of first documents, to urgently shred second documents urgently, one of the following three methods (1) to (3) would be adopted. Namely, in the method (1), the operator suspends shredding of the first documents and then, shreds the urgent second documents. In the method (2), the other person shreds the second documents by himself immediately after completion of the shredding of the first documents. On the other hand, in the method (3), the other person requests the operator to shred the second documents immediately after completion of the shredding of the first documents.

However, in the case where the method (1) in which the operator shreds the second documents by suspending the shredding of the first documents or the method (2) in which the other person shreds the second documents by himself after the operator has shredded the first documents undesirable, waste of time occurs. Meanwhile, in the case for the method (3) in which the other person requests the operator to shred the urgent second documents after shredding of the first documents, there is a possibility of an undesirable disclosure i.e. a leak of the confidential contents of the second documents.

Furthermore, installation of a plurality of the apparatuses for shredding the confidential documents leads to waste of cost and space.

SUMMARY OF THE INVENTION

Accordingly, an essential object of the present invention is to provide a shredder in which, even in the case where a large quantity of documents are being continuously shredded, other documents can be shredded efficiently, with substantial elimination of the disadvantages inherent in such conventional shredders.

In order to accomplish this and other objects of the present invention, there is provided a shredder in which documents are fed from a document loading portion to a document shredding portion so as to be .shredded by said document shredding portion, the improvement comprising: a document loading portion being including a plurality of document loading apertures such that the total quantity of documents capable of being fed from said document loading apertures to said document shredding portion is set so as to not exceed the shredding capability of said document shredding portion.

By the above described arrangement of the present invention, even when documents are being shredded by loading the documents into one of the plurality of document loading apertures, other documents can be concurrently loaded into one of the other document loading apertures.

Therefore, in accordance with the present invention, even when a large quantity of documents are being continuously shredded, other documents requiring an urgent shredding can be shredded at the same time, so that a waste of time is obviated and there is no possibility of the confidential contents of the documents being comprised.

Furthermore, in accordance with the present invention, two kinds of documents can be shredded at the same time by a single shredder, thereby resulting in saving of cost and space.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
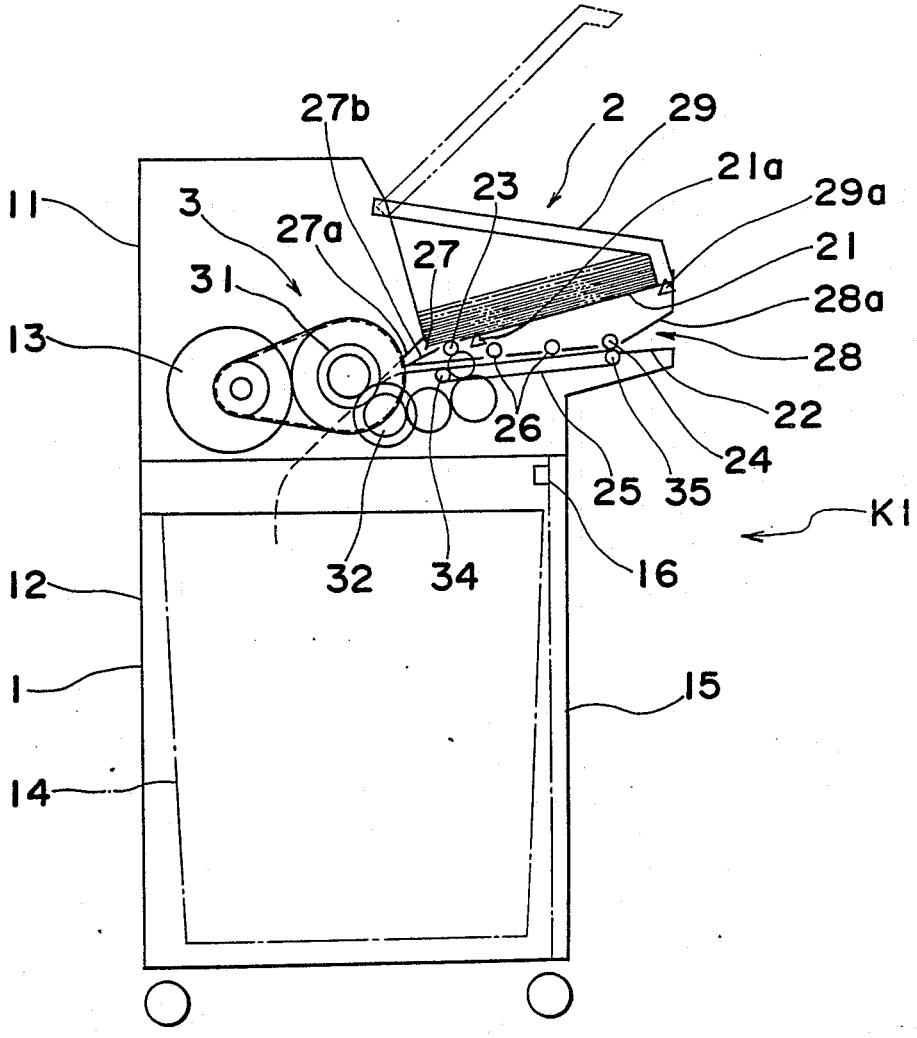
FIG. 1 is a schematic view showing a shredder according to a first embodiment of the present invention.

Referring now to the drawings, there is shown in FIG. 1, a shredder K1 according to a first embodiment of the present invention. The shredder K1 includes a housing 1 comprising an upper cabinet 11 and a lower cabinet 12. An upper portion of the shredder K1 is enclosed by the upper cabinet 11 in which a document loading portion 2 and a document shredding portion 3 are located, while a lower portion of the shredder K1 is enclosed by the lower cabinet 12 in which a receptacle for shredder paper is located. It is to be noted that the right side in FIG. 1 indicates a front portion of the shredder K1.

The document loading portion 2 includes a first document tray 21 and a second document tray 22. A first document loading roller 23 is disposed downwardly of and rearwardly of the first document tray 21 so as to transport documents on the first document tray 21 to the document shredding portion 3. A first document loading aperture 27 is defined by document guide 27*a* and a lower document guide 27*b* so as to be disposed rearwardly of the first document tray 21 such that the first document loading roller 23 is interposed between the first document tray 21 and the first document loading aperture 27. The upper document guide 27*a* and the lower document guide 27*b* are spaced such a distance as to allow a maximum of 15 documents of 50 g/m$^2$ to pass through the first document loading aperture 27. A tray cover 29 for danger preventive purpose is provided above the first document tray 21. The tray cover 29 is pivotally supported, at its one end, by the upper cabinet 11 so as to cover the first document tray 21. A tray cover sensor 29*a* is provided on the portion of the first document tray 21, which portion confronts the tray cover 29. A paper sensor 21*a* is provided at a position on the first document tray 21, at which position documents are placed on the first document tray 21.

The second document tray 22 is provided below the first document tray 21. A second document loading roller 24 is provided on the second document tray 22 so as to transport documents placed on the second document tray 22 towards the document shredding portion 3. A second document loading aperture 28 is disposed forwardly of the second document loading roller 24. A document guide 28*a* is provided at an upper portion of the second document loading aperture 28. The document guide 28*a* and the second document tray 22 are spaced such a distance as to allow a maximum of 7 documents of 50 g/m$^2$ to pass through the second document loading aperture 28. A transport belt 25 is disposed forwardly of the second document loading roller 24 and is wound around rollers 34 and 35 so as to transport to the document shredding portion 3 the documents fed towards the document shredding portion 3 by the second document loading roller 24. A pair of press rollers 26 are provided above the transport belt 25 so as to facilitate transport of the documents on the transport belt 25.

The document shredding portion 3 is comprised of by an upper cutter roller 31 and a lower cutter roller 32 each of which is provided, on its peripheral surface, with a cutter knife. The upper cutter roller 31 and the lower cutter roller 32 are driven for rotation thereof by a motor 13 so as to shred the documents fed from the document loading portion 2. The upper cutter roller 31 and the lower cutter roller 32 are capable of shredding up to 22 documents of 50 g/m$^2$ at a time.

The receptacle 14 is provided for collecting pieces of the documents shredded at the document shredding portion 3. A door 15 for taking the receptacle 14 out of the housing 1 is provided at a front face of the housing 1. A door switch 16 for detecting opening and closing of the door 15 is attached to the housing 1.

Figure 2:
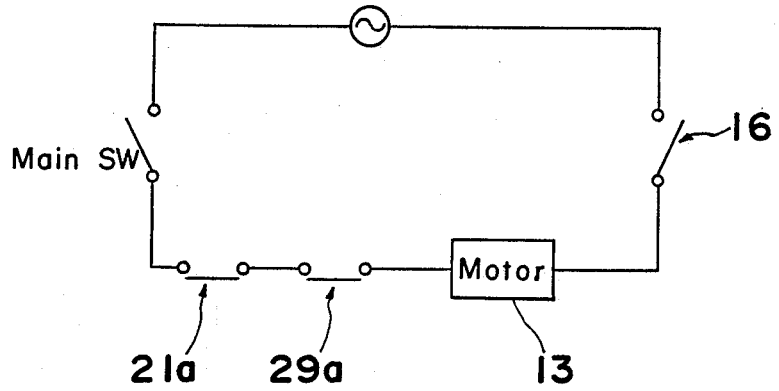
FIG. 2 is a circuit diagram of a drive circuit employed in the shredder of FIG. 1.

FIG. 2 shows a drive circuit employed in the shredder K1. In FIG. 2, the door switch 16 for the door 15, a switch compression part of the paper sensor 21*a* and a switch comprising part of the tray cover sensor 29*a* are connected in series to the motor 13. In operation, when a main switch is turned on and only the tray cover 29 is closed after documents or the like have been placed on the first document tray 21 but also the door 15 is closed, motor 13 becomes actuated causing rotation of the upper cutter roller 31, the lower cutter roller 32, the first document loading roller 23, the second document loading roller 24 and the rollers 34 and 35. The documents on the first document tray 21 are then carried in between the upper cutter roller 31 and the lower cutter roller 32. Fifteen (15) sheets at a time of the documents on the first document tray 21 are loaded into the first document loading aperture 27 as defined by the distance separating the upper document guide 27*a* and the lower document guide 27*b* and simultaneously shredded by the upper cutter roller 31 and the lower cutter roller 32. In the event other documents require shredding while the documents on the first document tray 21 are being continuously shredded as described above, the other documents are placed on the second document tray 22. Then, the other documents in piece on the second document tray 22 are fed in between the upper cutter roller 31 and the lower cutter roller 32 through rotation of the second document loading roller 24 and the transport belt 25 where they are then shredded by the upper cutter roller 31 and the lower cutter roller 32. The maximum number of the documents that can be fed from the second document tray 22 is set at 7 as determined by the separation distance between the document guide 28*a* and the second document tray 22. As noted above, the maximum number of the documents to be fed from the first document tray 21 is set at 15. Therefore, since the total of the maximum number of the documents to be fed as a set from the first document tray 21 and the maximum number of the documents to be fed as a set from the second document tray 22 is 22 i.e. 15+7, this equates the shredding capability of the document shredding portion 3, the documents fed from the first document tray 21 and the second document tray 22 can be shredded easily by the document shredding portion 3.

Although, in this embodiment, two document loading apertures are provided, it can also be so arranged so that three or more document loading apertures are provided.

Accordingly, in accordance with the first embodiment of the present invention, simultaneously with shredding a certain number of documents placed on the first document tray 21, other documents can be shredded by feeding the other documents from the second document tray 22 to the document shredding portion 3, thereby eliminating loss of time and preventing leakage of confidential contents of the other documents.

Thus, in accordance with the first embodiment of the present invention, two kinds of documents can be shredded simultaneously by a single shredder, thus resulting in saving of cost and space.

Figure 3:
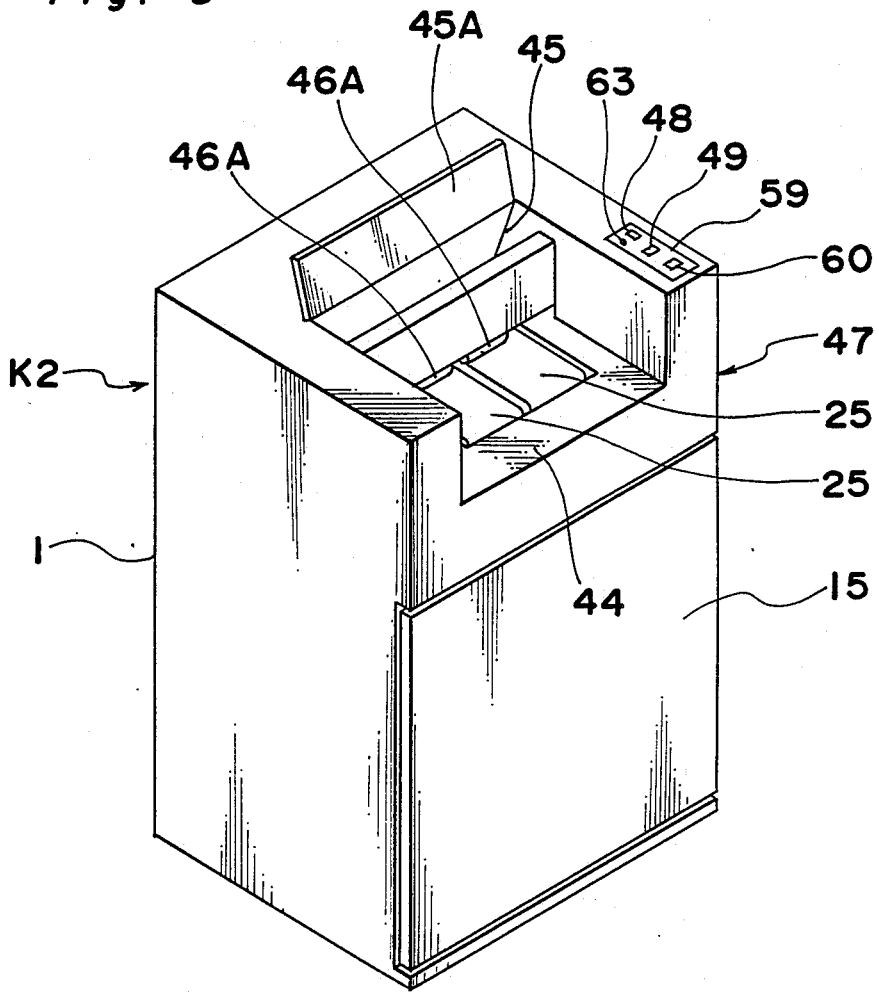
FIG. 3 is a perspective view of a shredder according to a second embodiment of the present invention.
Figure 4:
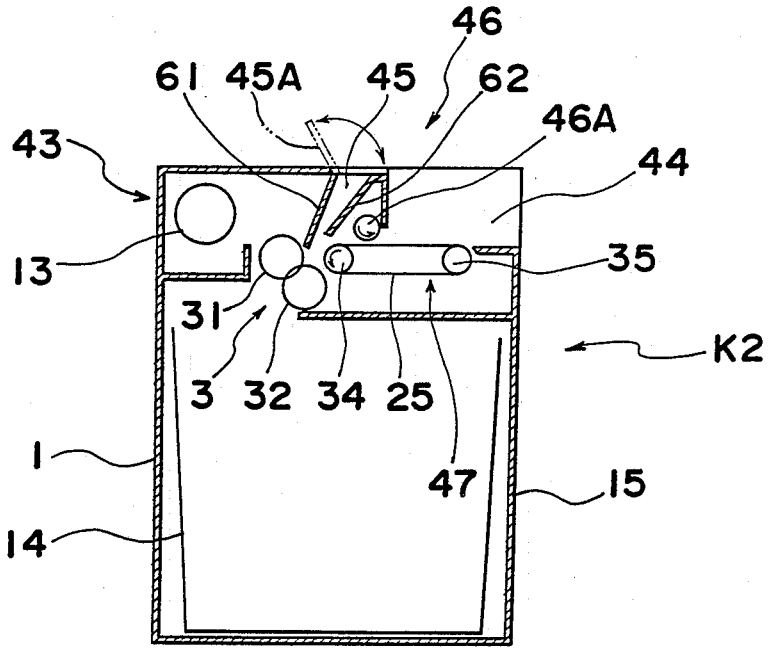
FIG. 4 is a sectional view of the shredder of FIG. 3.

Referring to FIGS. 3 and 4, there is shown a shredder K2 according to a second embodiment of the present invention. The shredder K2 includes upper and lower cutter rollers 31 and 32 rotatably provided at an upper portion of the housing 1, a drive unit 43 for driving the upper and lower cutter rollers 31 and 32 for rotation thereof, first and second document feeding portions 44 and 45 for feeding to the upper and lower cutter rollers 31 and 32 documents to be shredded. A regulating means 46 is additionally provided for adjusting the shredding capability of the upper and lower cutter rollers 31 and 32 by adjusting each of the maximum quantities of documents to be fed from the first and second document feeding portions 44 and 45 to the upper and lower cutter rollers 31 and 32, which is provided at the first and second document feeding portions 44 and 45. Provided further is a document feeding device 47 provided at the first document feeding portion 44, a selector switch 48 for driving and stopping the document feeding device 47, a starting switch 49 for driving and stopping the document feeding device 47 and a drive unit 43 and a control circuit 50 for controlling the drive unit 43 and the document feeding device 47 on the basis of output signals from the selector switch 48 and the starting switch 49.

The control circuit 50 has a function of outputting a signal for turning on the document feeding device 47 in response to an ON signal from the selector switch 48 for an ON state of the starting switch 49. The control circuit 50 further has a function of outputting a signal for turning off the document feeding device 47 in response to an OFF signal from the selective switch 48 for the ON state of the starting switch 49.

The shredder K2 is comprised of a document feeding device 47 for feeding the documents to be shredded, a document shredding portion 3 for shredding the documents and a receptacle 14 for collecting pieces of the documents shredded by the document shredding portion 3.

The first document feeding portion 44 is locates as the upper portion of a front face of the housing 1, while the second document feeding portion 45 is located on the central portion of an upper face of the housing 1. The document feeding device 47 includes rollers 34 and 35 for transporting to the upper and lower cutter rollers 31 and 32 documents loaded into the first document feeding portion 44, a transport belt 25 wound around the rollers 34 and 35, a motor 13 for driving the rollers 34 and 35 and a clutch 58 for transmitting to the rollers 34 and 35 a driving force of the motor 13.

The regulating means 46 comprises a counterrotating roller 46A disposed above the transport belt 25 at the first document feeding portion 44 and opposed guide plates 61 and 62 at the second document feeding portion 45. The guide plates 61 and 62 defines therebetween a document loading aperture for the second document feeding portion 45. A cover 45A for opening and closing the second document feeding portion 45 is provided at the second document feeding portion 45.

Further, as shown in FIG. 3, an operating portion 59 is provided on the upper face of the housing 1 and includes the selector switch 48, the starting switch 49, a stop switch 60 for suspending a shredding operation and an indicating lamp 63 for indicating drive of the document feeding device 47.

The document shredding portion 3 includes the upper and lower cutter rollers 31 and 32 and the motor 13 for driving the upper and lower cutter rollers 31 and 32, which also acts also as the document feeding device 47 as described above. The upper and lower cutter rollers 31 and 32 have the shredding capability for about 20 documents of 50 $g/m^2$, namely the upper and lower cutter rollers 31 and 32 are capable of shredding up to about 20 documents of 50 $g/m^2$ at a time. Also, as shown in FIG. 4, a door 15 is provided on a front face of the housing 1 so as to access the receptacle 14.

Figure 5:
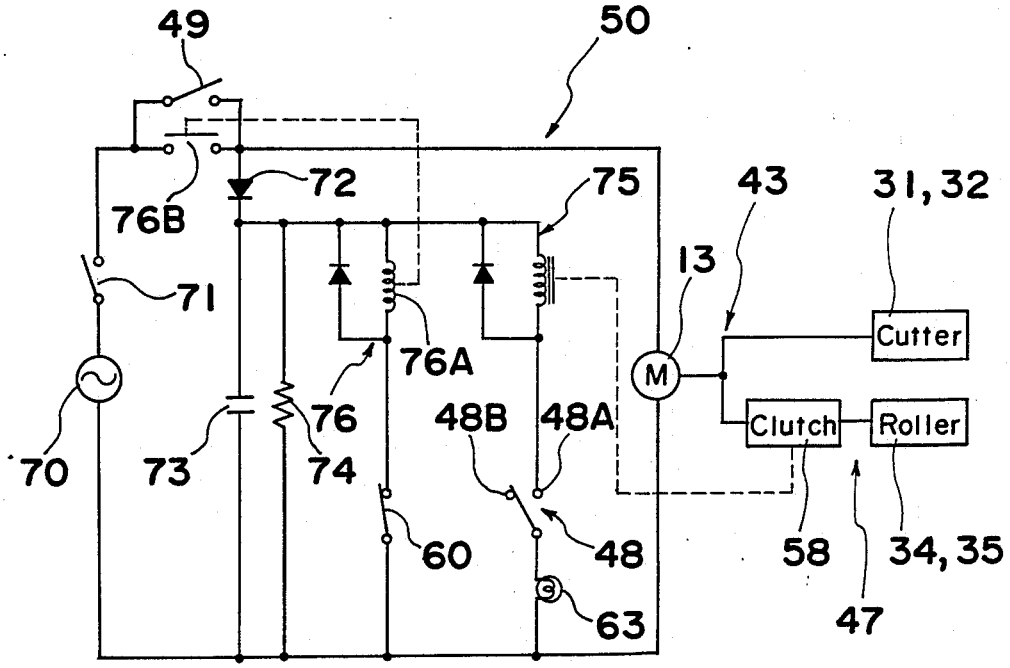
FIG. 5 is a circuit diagram of a control circuit employed in the shredder of FIG. 3.

As shown in FIG. 5, the control circuit 50 includes an AC power source 70, a power source switch 71, a diode 72, a capacitor 73, a resistor 74, a solenoid 75 and a relay 76. A rectification filter circuit is formed by the diode 72, the capacitor 73 and the resistor 74 and is connected, through the power source switch 71 and the starting switch 49, to the AC power source 70. A solenoid 75, which is energized and deenergized in response to the turning on and off of the selective switch 48, and the relay 76, which is energized and deenergized in response to turning on and off of the stop switch 60, are connected to the rectification filter circuit. The solenoid 75 is connected in series with the selector switch 48 such that the clutch 58 is turned on in response to energization of the solenoid 75. Additionally, the selector switch 48 includes an ON contact 48A and an OFF contact 48B. A relay coil 76A of the relay 76 is connected in series with the stop switch 60, while a normally open relay contact 76B of the relay 76 is connected in series with the motor 13 together with the power source switch 71.

In accordance with the above described arrangement of the shredder K2, in the case where documents from only the first document feeding portion 44 are shredded, the power source switch 71 is turned on and then, the starting switch 49 is depressed, so that a DC voltage is provided by the diode 72, the capacitor 73 and the resistor 74. Hence, the coil 76A of the relay 76 is energized, causing the normally open relay contact 76B of the relay 76 to close and thus, the motor 13 is rotated so as to shred the documents. At this time, if the selector switch 48 is set to the ON contact 48A, the indicating lamp 63 is turned on and the solenoid 75 is energized so that the clutch 58 is turned on so as to drive the document feeding device 47.

If the selector switch 48 is now depressed once, the contractor of the selector switch 48 is changed over to the OFF contact 48B, so that the indicating lamp 63 is turned off and the clutch 58 is turned off and operation of the document feeding device 47 is stopped. However, at this time, since the motor 13 does not stop if the stop switch 60 is not turned off, drive of the upper and lower cutter rollers 31 and 32 continues. Thus, after drive of the document feeding device 47 has been stopped by turning off the selector switch 48 during shredding of the documents from the first document feeding portion 44, confidential documents can be loaded for shredding into the second document feeding portion 45. Thereafter, when shredding of the documents from the second document feeding portion 45 has been completed, the document feeding device 47 is driven by turning on the selector switch 48 and thus, shredding of the documents from the first document feeding portion 44 can be resumed.

Meanwhile, since changeover between drive and stop of the document feeding device 47 can be performed regardless of whether or not the upper and lower cutter rollers 31 and 32 are being driven, it becomes possible to positively prevent documents exceeding the shredding capability of the upper and lower cutter rollers 31 and 32 from being fed in between the upper and lower cutter rollers 31 and 32.

As will be seen from the foregoing description, in the second embodiment of the present invention, the control circuit 50 outputs a signal for driving the document feeding device 47 in response to the ON signal of the selective switch 48 and stops the document feeding device 47 in response to the OFF signal of the selector switch 48. Therefore, after drive of the document feeding device 47 has been stopped by turning off the selective switch 48 during shredding of the documents from the first document feeding portion 44, the confidential documents can be loaded into the second document feeding portion 45 for shredding. Then, after shredding of the confidential documents from the second document feeding portion 45 has been completed, the document feeding device 47 is driven by turning on the selector switch 48 and thus, shredding of the documents from the first document feeding portion 44 can be resumed. At this time, since each of the maximum quantities of the documents fed from the first document feeding portion 44 and the second document feeding portion 45 to the upper and lower cutter rollers 31 and 32 is set to the shredding capability of the upper and lower cutter rollers 31 and 32, shredding efficiency of the shredder can be improved. Furthermore, when documents have been fed from the second document feeding portion 45 to the upper and lower cutter rollers 31 and 32, the documents from the second document feeding portion 45 are shredded with a priority over the documents from the first document feeding portion 44, so that a leak of the confidential contents of the documents to be loaded into the second document feeding portion 45 can be prevented and it becomes possible to prevent the documents exceeding the shredding capability of the upper and lower cutter rollers 31 and 32 from being fed in between the upper and lower cutter rollers 31 and 32.

Figure 6:
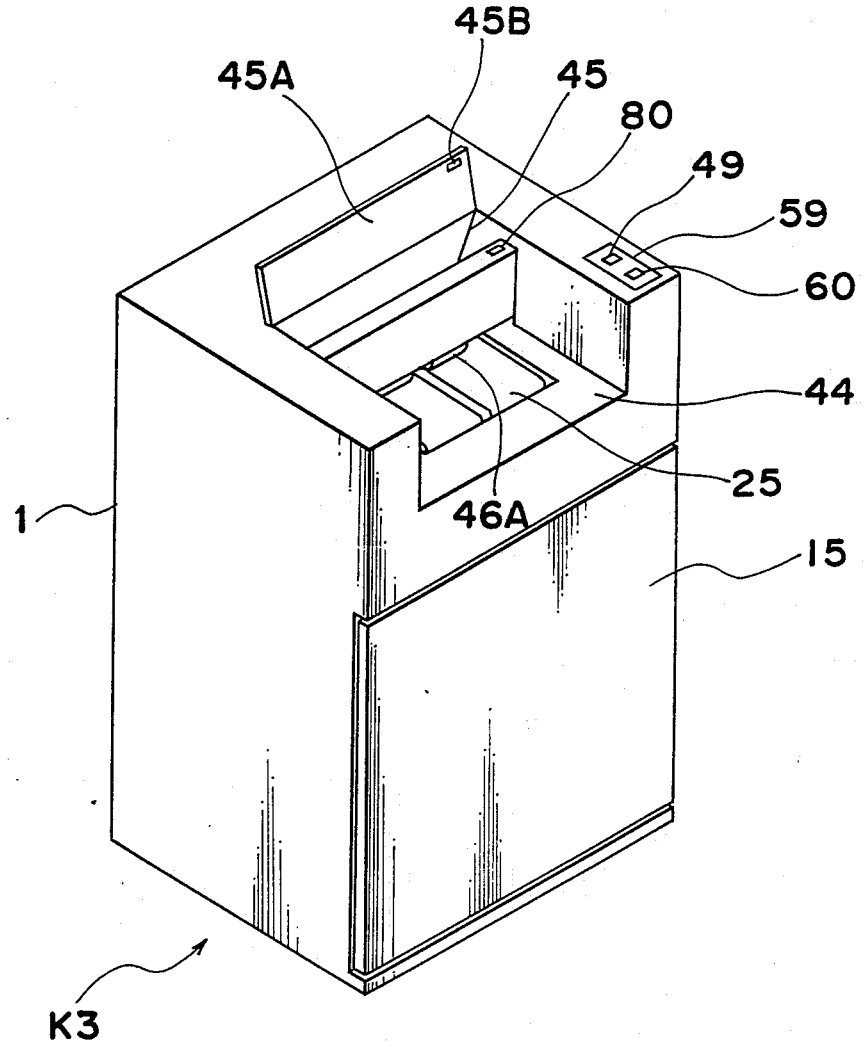
FIG. 6 is a view similar to FIG. 3, particularly showing a shredder according to a third embodiment of the present invention.

Referring now to FIG. 6, there is shown a shredder K3 according to a third embodiment of the present invention. In the shredder K3, the selector switch 48 of the shredder K2 is replaced by a detection switch 80 for detecting the opening and closing of the cover 45A for the second document feeding portion 45 such that the control circuit 50 controls the drive unit 43 and the document feeding device 47 response of the output signals of the detection switch 80 and the starting switch 49. A reed switch, for example, acts as the detection switch 80. The cover 45A is pivotally supported at an upper inlet of the second document feeding portion 45 so as to open and close the second document feeding portion 45. A magnet 45B is provided at a rear face of the cover 45A so as to be brought into contact with the detection switch 80 provided on the housing 1. In the shredder K3, the motor 13 is of the capacitor start type and an electromagnetic clutch acts as the clutch 58. Since other part of the shredder K3 are similar to those of the shredder K2, detailed description thereof is abbreviated for the sake of brevity. Therefore, it is to be noted that FIG. 4 of the shredder K2 is likewise applicable to the shredder K3.

The control circuit 50 has the function of generating and outputting a signal for driving the document feeding device 47 in response to an ON signal of the detection switch 80. The control device 50 further has a function of outputting a signal for stopping the document feeding device 47 in response to an OFF signal of the detection switch 80.

In the shredder K3, the upper and lower cutter rollers 31 and 32 are capable of shredding up to about 20 documents of 50 g/m$^2$ at a time. The regulating means 46 for adjusting of the shredding capability of each of the upper and lower cutter rollers 31 and 32 with the maximum quantities of documents to be fed from the first and second document feeding portions 44 and 45 to the upper and lower cutter rollers 31 and 32 is comprises roller 46A provided at the first document feeding portion 44 and the guide plates 61 and 62 provided at the second document feeding portion 45. The transport belt 25 and the counterrotating roller 46A is spaced such a distance as to allow a maximum of 20 documents of 50 g/m$^2$ to pass therethrough. Meanwhile, in the second document feeding portion 45, the document confronting guide plates 61 and 62 are so formed as to directly guide the dccuments from the upper inlet of the second document feeding portion 45 to the upper and lower cutter rollers 31 and 32. The guide plates 61 and 62 are spaced such a distance as to allow a maximum of 20 documents of 50 g/m$^2$ to pass therethrough.

Furthermore, as shown in FIG. 6, the starting switch 49 and the stop switch 60 for suspending shredding operation are provided on the operating portion 59.

Figure 7:
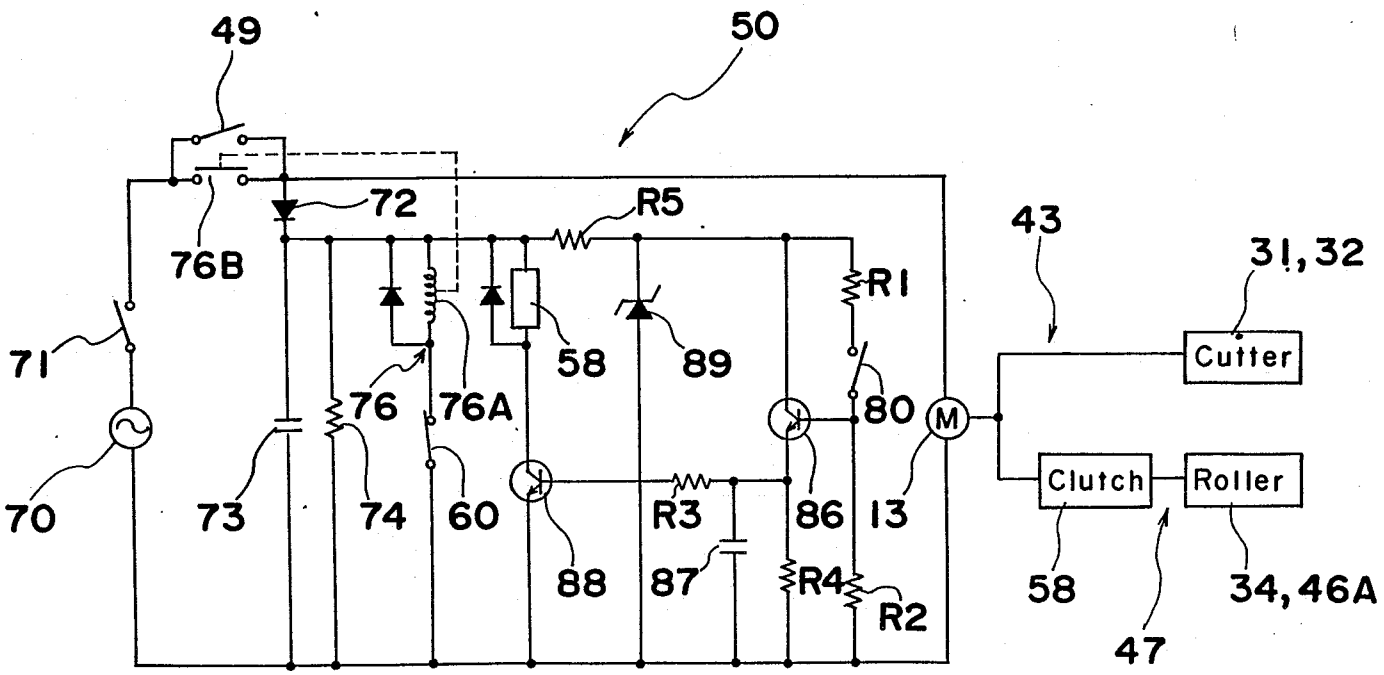
FIG. 7 is a circuit diagram of a control circuit employed in the shredder of FIG. 6.

Referring now to FIG. 7, the control circuit 50 includes an AC power source 70, a power source switch 71, a diode 72, a capacitor 73, a resistor 74 and a relay 76 having a coil 76A and a normally open relay contact 76B connected in the same manner as the shredder K2. The rectification filter circuit is realized by a diode 72, a capacitor 73 and a resistor 74 connected, via the power source switch 71 and the starting switch 49, to the AC power source 70. The relay 76, which is energized and deenergized in response to turning on and off of the stop switch 60, and the clutch 58, is energized and deenergized in response to turning on and off of the detection switch 80, and are connected to the rectification filter circuit. The coil 76A of the relay 76 is connected in series to the stop switch 60, while the normally open relay contact 76B of the relay 76 is connected in series to the motor 13 together with the power source 71.

A circuit for turning the clutch 58 on and off includes a first transistor 86 and a second transistor 88. The base of the first transistor 86 is connected to the junction of a resistor R2 and the detection switch 80 leading to a resistor R1. The emitter of the first transistor 86 is connected, by way of a delay circuit including a capacitor 87 and resistors R3 and R4, to the base of the second transistor 88 whose collector is connected to the clutch 58. A resistor R5 and a Zener diode 89 are provided for obtaining a low voltage for actuating the first transistor 86.

In accordance with the above described arrangement of the shredder K3, in the case where the documents from only the first document feeding portion 44 are shredded, the power source switch 71 is turned on and the starting switch 49 is depressed, so that a DC voltage is obtained by the diode 72, the capacitor 73 and the resistor 74. Therefore, the coil 76A of the relay 76 is energized closing the normally open relay contact 76B and thus, the motor 13 is activated to shred the documents.

If the stop switch 60, which is normally as closed switch, is depressed at this time, electric current will not flow through the coil 76A of the relay 76, so that the normally open relay contact 76B is opened and the motor 13 stops.

Meanwhile, since the detection switch 80 is in an ON state while the cover 45A is being closed, the first transistor 86 is turned on and then, the second transistor 88 is turned on upon the end of a time delay as determined by the capacitor 87 and the resistors R3 and R4, so that the clutch 58 is turned on causing the rotational force of the motor 13 to be transmitted to the transport belt 25.

In the case where confidential documents or the like are required to be urgently shredded during a shredding of the documents at the first document feeding portion 44, the cover 45A is opened so as to enable use of the second document feeding portion 45. Therefore, the detection switch 80 is turned off and thus, the first transistor 86 is turned off. Subsequently, and after a short while, the second transistor 88 is turned off, so that the clutch 58 is turned off and thus, the rotational force of the motor 13 is uncoupled from the document feeding device 47.

Thus, when the cover 45A of the second document feeding portion 45 has been opened, operation of the transport belt 25 is inhibited and documents are prevented from being fed simultaneously to the upper and lower cutter rollers 31 and 32 from the first and second documents feeding portions 44 and 45.

Subsequently, when the cover 45A is closed after the documents from the second document feeding portion 45 have been shredded, the detection switch 80 is turned on, so that the document feeding device 47 is again driven and thus, shredding of the documents from the first document feeding portion 44 can be resumed.

Also, since changeover between drive and stop of the document feeding device 47 can be performed regardless of whether or not the upper and lower cutter rollers 31 and 32 are being driven for rotation thereof, it becomes possible to positively prevent documents exceeding the shredding capability of the upper and lower cutter rollers 31 and 32 from being fed in between the upper and lower cutter rollers 31 and 32.

As will be understood from the foregoing, in the third embodiment of the present invention, when the cover 45A of the second document feeding portion 45 is closed, the detection switch 80 is turned on, so that the document feeding device 47 is powered. Meanwhile, when the cover 45A is opened, the direction switch 80 is turned off and thus, the document feeding device 47 is stopped. Therefore, when the cover 45A is opened during shredding of the documents from the first document feeding portion 44, the document feeding device 47 for the first document feeding portion 44 is stopped, so that the documents from the second document feeding portion 45 are shredded with a priority over the documents from the first document feeding portion 44. Subsequently, when the cover 45A is closed upon completion of shredding of the documents from the second document feeding portion 45, the detection switch 80 is turned on, so that the document feeding device 47 is driven again and thus, shredding of the documents from the first document feeding portion 44 can be resumed.

Consequently, in accordance with the third embodiment of the present invention, shredding efficiency of the shredder can be improved by adjusting to the shredding capability of the upper and lower cutter rollers 31 and 32 to the maximum quantity of the documents fed from the first document feeding portion 44 to the upper and lower cutter rollers 31 and 32. Furthermore, when the documents are fed from the second document feeding portion 45 during shredding of the documents from the first document feeding portion 44, the documents from the second document feeding portion 45 can be shredded with a priority over the documents from the first document feeding portion 44, so that any leakage of confidential contents of the documents from the second document feeding portion 45 is prevented and it becomes possible to prevent document exceeding the shredding capability of the upper and lower cutter rollers 31 and 32 from being fed in between the upper and lower cutter rollers 31 and 32.

Figure 8:
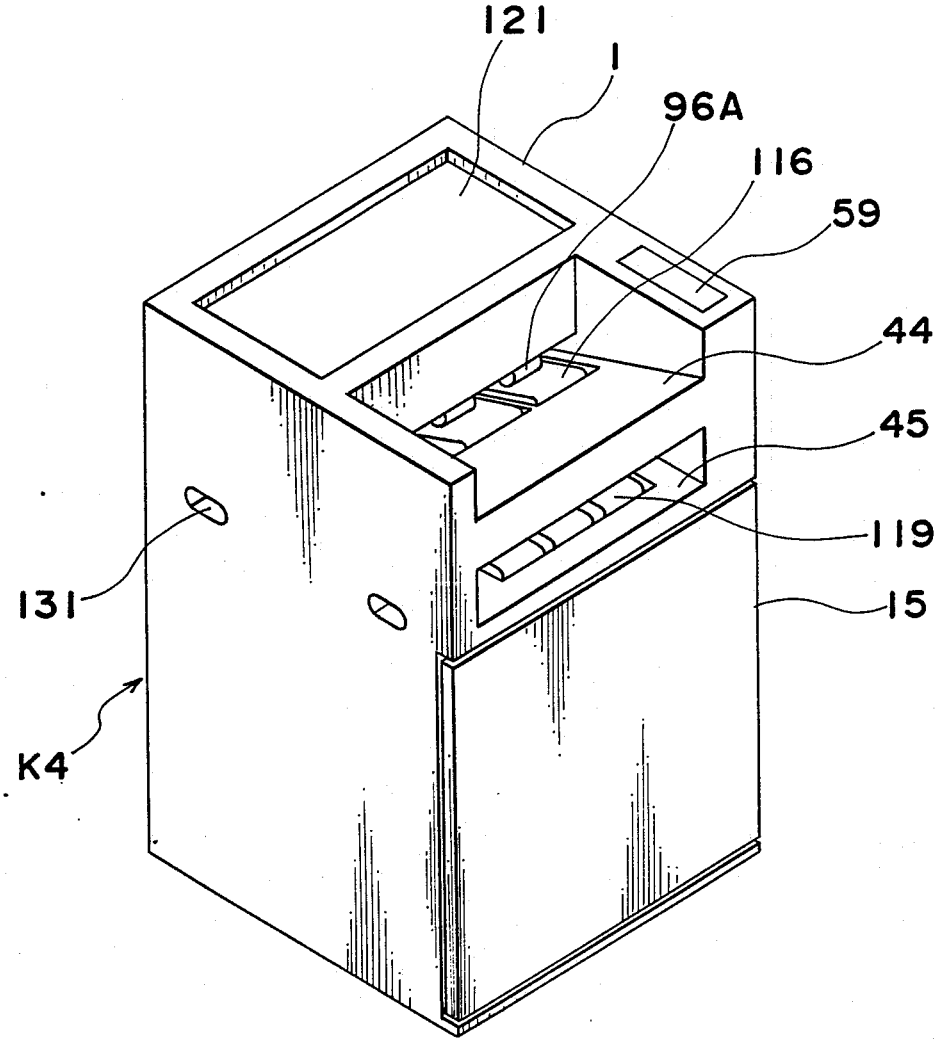
FIG. 8 is a perspective view of a shredder according to a fourth embodiment of the present invention.
Figure 9:
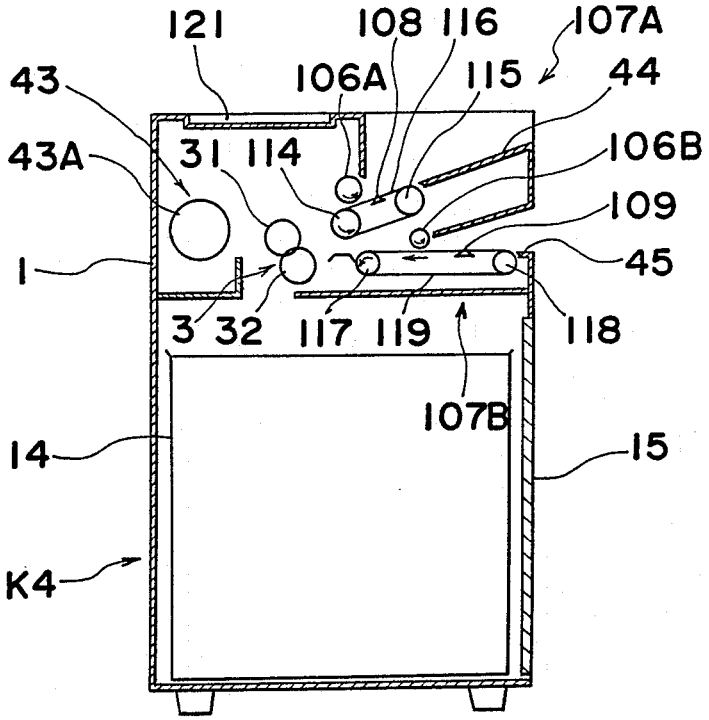
FIG. 9 is a sectional view of the shredder of FIG. 8.

Referring further to FIGS. 8 and 9, there is shown a shredder K4 according to a fourth embodiment of the present invention. The shredder K4 includes upper and lower cutter rollers 31 and 32 provided at the upper portion of a housing 1, the drive unit 43 for driving the upper and lower cutter rollers 31 and 32 for rotation thereof, first and second document feeding portions 44 and 45 for feeding documents to be shredded to the upper and lower cutter rollers 31 and 32, a first regulating means 106A for adjusting to the shredding capability of the upper and lower cutter rollers 31 and 32 to a maximum quantity of the documents which can be fed from the first document feeding portion 44 to the upper and lower cutter rollers 31 and 32 and which is provided at the first document feeding portion 44. A second regulating means 106B for adjusting the shredding capability of the upper and lower cutter rollers 31 and 32 to a maximum quantity of documents to which can be fed from the second document feeding portion 45 to the upper and lower cutter rollers 31 and 32 and which is provided at the second document feeding portion 45. A first document feeding device 107A is provided at the first document feeding portion 44 and a second document feeding device 107B is provided at the second document feeding device 45. Also provided are a first detection switch 108 for detecting presence and absence of the documents in the first document feeding device 44, a second detection switch 109 for detecting presence and absence of the documents in the second document feeding portion 45 and a control circuit 50 for controlling the first and second document feeding devices 107A and 107B on the basis of output signals of the first and second detection switches 108 and 109, respectively. A microswitch, for example, acts as each of the first and second detection switches 108 and 109. The microswitch can also be replaced by a photosensor.

The control circuit 50 has a function of generating an output signal for driving the first document feeding device 107A in response to a signal from the first detection switch 108 representing presence of the documents in the first document feeding portion 44 and a function of generating an output signal for driving the second document feeding device 107B in response to a signal from the second detection switch 108 representing presence of the documents in the second document feeding portion 45. Furthermore, the control circuit 50 has a function of not only stopping the first document feeding device 107A but driving the second document feeding device 107B with a priority over the first document feeding device 107A in response to the signal from the first detection switch 108 representing presence of the documents in the first document feeding device 44 and the signal of the second detection switch 109 representing presence of the documents in the second document feeding portion 45.

The shredder K4 is mainly constituted by the first and second document feeding portions 44 and 45, the first document feeding device 107A for feeding the documents from the first document feeding portion 44 to the document shredding portion 3, the second document feeding device 107B for feeding the documents from the second document feeding portion 45 to the document shredding portion 3, the document shredding portion 3 for shredding documents fed by the first and second document feeding devices 107A and 107B and the receptacle 14 for collecting pieces of the documents shredded by the document shredding portion 3.

The first document feeding device 107A includes rollers 114 and 115 for feeding to the upper and lower cutter rollers 31 and 32 the documents loaded into the first document feeding portion 44, a transport belt 116 wound around the rollers 114 and 115 and a first motor M1 for driving the rollers 114 and 115.

Meanwhile, the second document feeding device 107B includes rollers 117 and 118 for feeding to the upper and lower cutter rollers 31 and 32 the documents loaded into the second document feeding portion 45, a transport belt 119 wound around the rollers 117 and 118 and a second motor M2 for driving the rollers 117 and 118.

The document shredding portion 3 includes rotatable upper and lower cutter rollers 31 and 32 and a shredding motor 43A functioning as the drive unit 43. The upper and lower cutter rollers 31 and 32 have a shredding capacity of about 20 documents of 50 g/m$^2$.

The first document feeding portion 44 is formed at the front portion of the upper face of the housing 1 such that 500 to 600 documents can be set at the first document feeding portion 44 at a time. The first regulating means 106A for regulating the quantity of the documents fed from the first document feeding portion 44 to the document shredding portion 3 includes a counterrotating roller provided above the transport belt 116. The transport belt 116 and the counterrotating roller 106A are spaced such a distance as to allow a maximum of 20 documents to pass therethrough.

The second document feeding portion 45 is formed at an upper portion of the housing 1 so as to be disposed below the first document feeding portion 44. It is impossible to set at the second document feeding portion 45 as many documents as those for the first document feeding portion 44. The second regulating means 106B for regulating the quantity of the documents fed from the second document feeding portion 45 to the document shredding portion 3 includes a counterrotating roller provided above the transport belt 119. The transport belt 119 and the counterrotating roller 106B are spaced a distance so as to allow a maximum of 20 documents to pass therethrough. However, the quantity of the documents fed from the second document feeding portion 45 to the document shredding portion 3 may be set to an arbitrary value not more than the shredding capability of the upper and lower cutter rollers 31 and 32.

As shown in FIG. 8, there are further provided on the upper face of the housing 1, an operating portion 59 and a storage recess 121 for storing residual documents which could not be loaded into the first and second document feeding portions 44 and 45. Meanwhile, recessed grips 131 are formed on opposite side faces of the housing 1.

Figure 10:
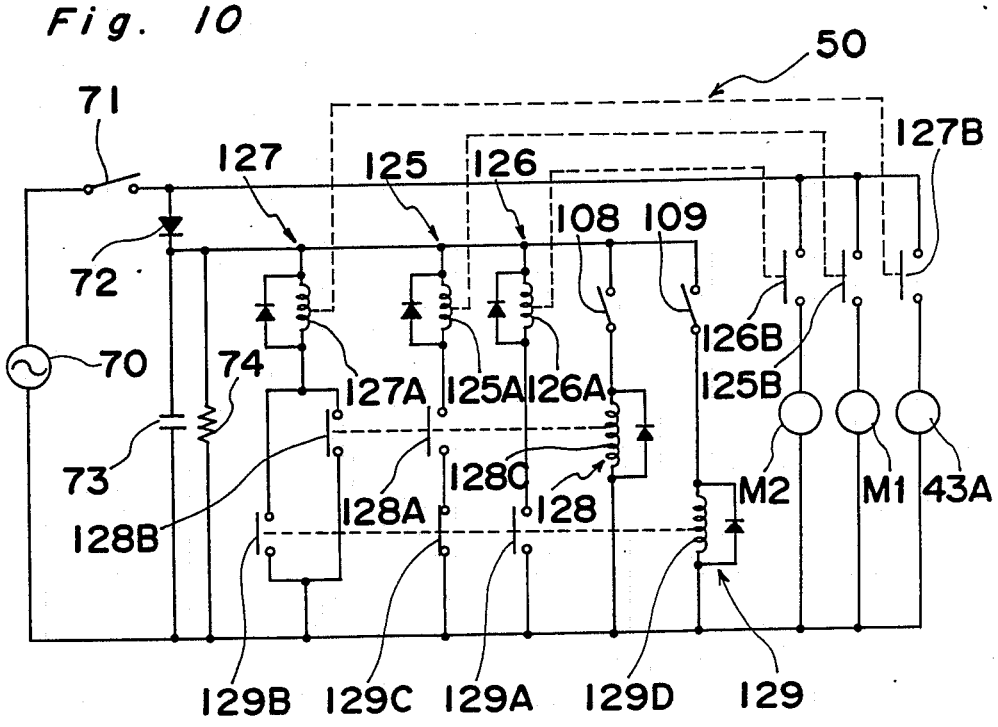
FIG. 10 is a circuit diagram of a control circuit employed in the shredder of FIG. 8.

As shown in FIG. 10, the control circuit 50 includes the AC power source 70, the power source switch 71, the diode 72, the capacitor 73 and the resistor 74. The rectification filter circuit formed by the diode 72, the capacitor 73 and the resistor 74 is connected, through the power source switch 71, to the AC power source 70. The control circuit 50 further includes a first relay 125, a second relay 126, a shredding relay 127, a first detection relay 128 and a second detection relay 129. The first detection relay 128 is energized and deenergized in response to the turning on and off of the first detection switch 108, while the second detection relay 129 is energized and deenergized in response to the turning on and off of the second detecting switch 109. The first relay 125, the second relay 126, the shredding relay 127, the first detection relay 128 and the second detection relay 129 are connected to the rectification filter circuit.

The first detection relay 128 includes two normally open contacts 128A and 128B and a coil 128C of the first detection relay 128 is connected in series to the first detection switch 108. The normally open contact 128A is connected in series to a coil 125A of the first coil 125, while the normally open contact 128B is connected to a coil 127A of the shredding relay 127.

Further, the second detection relay 129 includes two normally open contacts 129A and 129B and one normally closed contact 129C. A coil 129D of the second detection relay 129 is connected in series to the second detection switch 109. The normally open contact 129A is connected in series to a coil 126A of the second relay 126, while the normally open contact 129B of the first detection relay 128. The normally closed contact 129C is connected in series to the normally open contact 128A of the first detection relay 128.

A normally open contact 125B of the first relay 125 is connected in series to the first motor M1. Meanwhile, a normally open contact 126B of the second relay 126 is connected in series to the second motor M2. A normally open contact 127B of the shredding relay 127 is connected in series to the shredding motor 43A.

By the above described embodiment of the shredder K4, if documents are fed from both the first document feeding portion 44 and the second document feeding portion 45 to the upper and lower cutter rollers 31 and 32, an undesirable phenomenon could occur when documents exceeding the shredding capability of the upper and lower cutter rollers 31 and 32 are fed to the upper and lower cutter rollers 31 and 32, thereby resulting in application of an overload to the shredding motor 43A. In this case, after shredding of the documents is suspended the extra large quantity of the documents being fed to the upper and lower cutter rollers 31 and 32 must be removed from the upper and lower cutter rollers 31 and 32, and then refed again.

However, in order to eliminate the undesirable phenomenon referred to above, the shredder K4 is configured such that documents are prevented from being fed simultaneously to the upper and lower cutter rollers 31 and 32 from both the first document feeding portion 44 and the second document feeding portion 45. Accordingly, in the case where the documents have been loaded into both the first document feeding portion 44 and the second document feeding portion 45, only the second document feeding device 107B for the second document feeding portion 45 is driven such that the documents loaded into the second document feeding portion 45 are shredded with a priority over the documents loaded into the first document feeding portion 44. After the documents loaded into the second document feeding portion 45 have been shredded, the documents loaded into the first document feeding portion 44 are then shredded.

Also, if the documents are loaded into the second document feeding portion 45 while the documents from the first document feeding portion 44 are being shredded, the first document feeding device 107A for the first document feeding portion 44 is stopped so that the documents loaded into the second document feeding portion 45 are shredded with a priority over the documents from the first document feeding portion 44.

This control is performed as follows. When the power source switch 71 is turned on, a DC voltage is obtained by the diode 72, the capacitor 73 and the resistor 74. When the documents are loaded into the first document feeding portion 44 and therefore, the first detection switch 108 is closed, the coil 128C of the first detection relay 128 is energized and thus, the normally open contacts 128A and 128B of the first detection relay 128 are closed.

Meanwhile, when the documents are loaded into the second document feeding portion 45 and therefore, the second detection switch 109 is closed, the coil 129D of the second detection relay 129 is energized, so that the normally open contacts 129A and 129B are closed and the normally closed contact 129C is opened.

Hereinbelow, operation of shredder K4 in response to turning on and off of the first detection switch 108 and the second detection switch 109 in combination will now be described.

(1) When no documents are loaded into either of the first and second document feeding portions 44 and 45, the first and second detection switches 108 and 109 are turned off. Since the normally open contacts 125B, 126B and 127B are all left closed, the shredding motor 43A and the first and second motors Ml and M2 are held in a stop state.

(2) When documents are loaded into only the first document feeding portion 44, the first detection switch 108 is turned on and the second detection switch 109 is turned off. Since the normally open contacts 128A and 128B are closed, electric current flows through the coils 125A and 127A, so that the normally open contacts 125B and 127B are closed and thus, the first motor Ml and the shredding motor 43A are driven. Hence, the first document feeding device 107A for the first document feeding portion 44 and the upper and lower cutter rollers 31 and 32 are driven, while the second document feeding device 107B for the second document feeding portion 45 is held in the stop state.

(3) When documents are loaded into only the second document feeding portion 45, the first detection switch 108 is turned off and the second detection switch 109 is turned on. Since the normally open contacts 129A and 129B are closed, electric current flows through the coils 126A and 127A and thus, the second motor M2 and the shredding motor 43A are driven. Therefore, the second document feeding device 107B for the second document feeding portion 45 and the upper and lower cutter rollers 31 and 32 are driven, while the first document feeding device 107A for the first document feeding portion 44 is held in a stop state.

(4) When documents are loaded into both the first and second document feeding portions 44 and 45, the first and second detection switches 108 and 109 are turned on. Hence, the normally open contacts 128A, 128B, 129A and 129B are closed and the normally closed contact 129C is opened. Thus, since electric current flows through the coils 126A and 127A, the normally open contacts 126B and 127B are closed and thus, the second motor M2 and the shredding motor 43A are driven. Therefore, even if the documents are loaded into the first document feeding portion 44, only the second document feeding device 107B and the upper and lower cutter rollers 31 and 32 are driven in the same manner as the above case (3), namely the first document feeding device 107A for the first document feeding device 44 is not driven.

Consequently, when the documents are loaded into the second document feeding portion 45 during shredding of the documents from the first document feeding portion 44, shredding of the documents from the first document feeding portion 44 is suspended and the documents from the second document feeding portion 45 are shredded with a priority over the documents from the first document feeding portion 44. Subsequently, when the documents from the second document feeding portion 45 have been shredded by priority over the documents from the first document feeding portion 44, shredding of the documents from the first document feeding portion 44 is resumed automatically.

As will be seen from the description given so far, in the fourth embodiment of the present invention, in the case where the document to be shredded are loaded into both the first and second document feeding portions 44 and 45 or in the case where the documents are loaded into the second document feeding portion 45 even during shredding of the documents from the first document feeding portion 44, the control device 50 drives only the second document feeding device 107B for the second document feeding portion 45 in response to the signals of the first and second detection switches 108 and 109 representing presence of the documents in the first and second document feeding portions 44 and 45 such that the documents from the second document feeding portion 45 are shredded with a priority over the documents from the first document feeding portion 44. Thereafter, when the documents loaded into the second document feeding portion 45 have been shredded, a signal representing absence of the documents in the second document feeding portion 45 is outputted from the second detection switch 109, so that the control circuit 50 commands shredding of the documents loaded into the first document feeding portion 44. Accordingly, in the fourth embodiment of the present invention, the shredding capability of the shredder can be improved by adjusting the shredding capability of each of the upper and lower cutter rollers 31 and 32 for the quantities of the documents fed from the first and second document feeding portions 44 and 45. Furthermore, in the fourth embodiment of the present invention, when confidential documents are loaded into the second document feeding portion 45 during shredding of the documents from the first document feeding portion 44, the confidential documents are shredded with a priority over the documents from the first document feeding portion 44, so that a leak of contents of the confidential documents loaded into the second document feeding portion 45 can be prevented and it becomes therefore possible to prevent documents exceeding the shredding capability of the upper and lower cutter rollers 31 and 32 from being fed in between the upper and lower cutter rollers 31 and 32.

Figure 11:
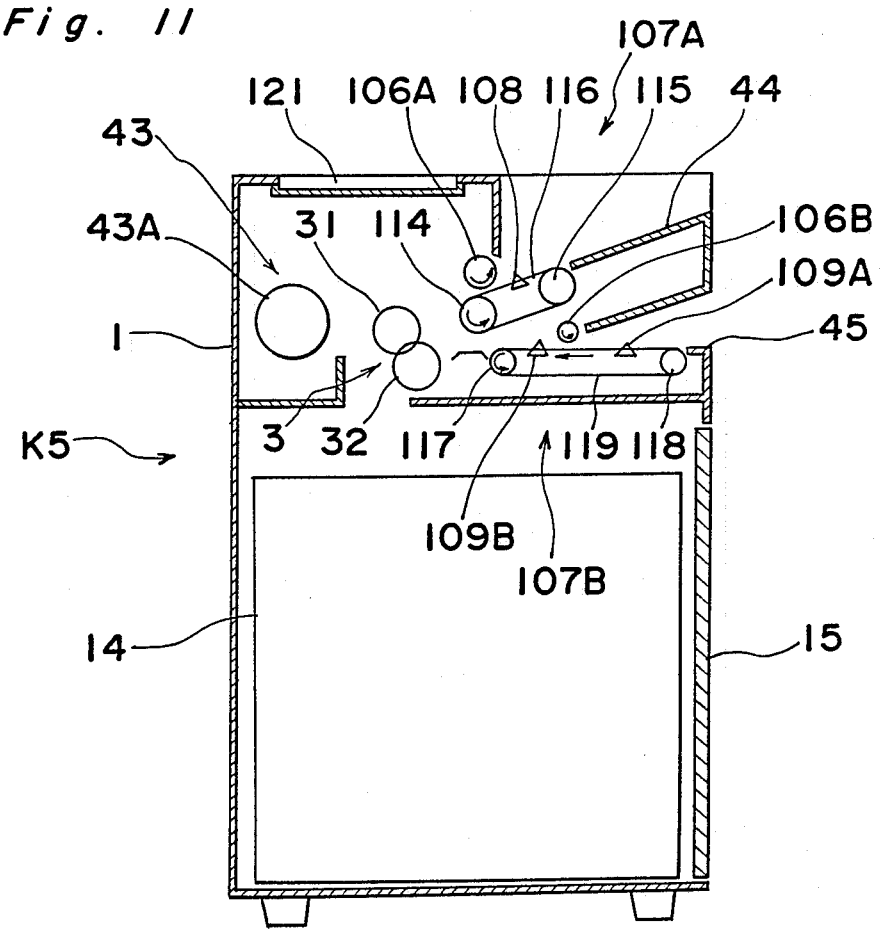
FIG. 11 is a view similar to FIG. 9, particularly showing a shredder according to a fifth embodiment of the present invention.
Figure 12:
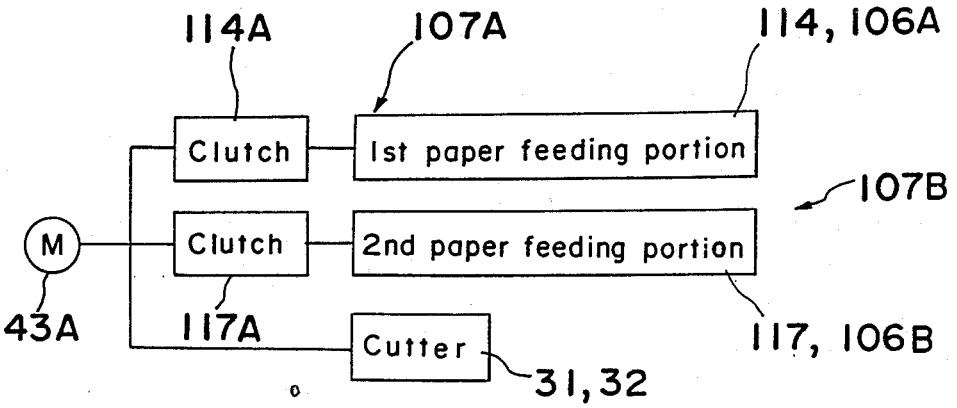
FIG. 12 is a block diagram of a document feeding portion of the shredder of FIG. 11.
Figure 13:
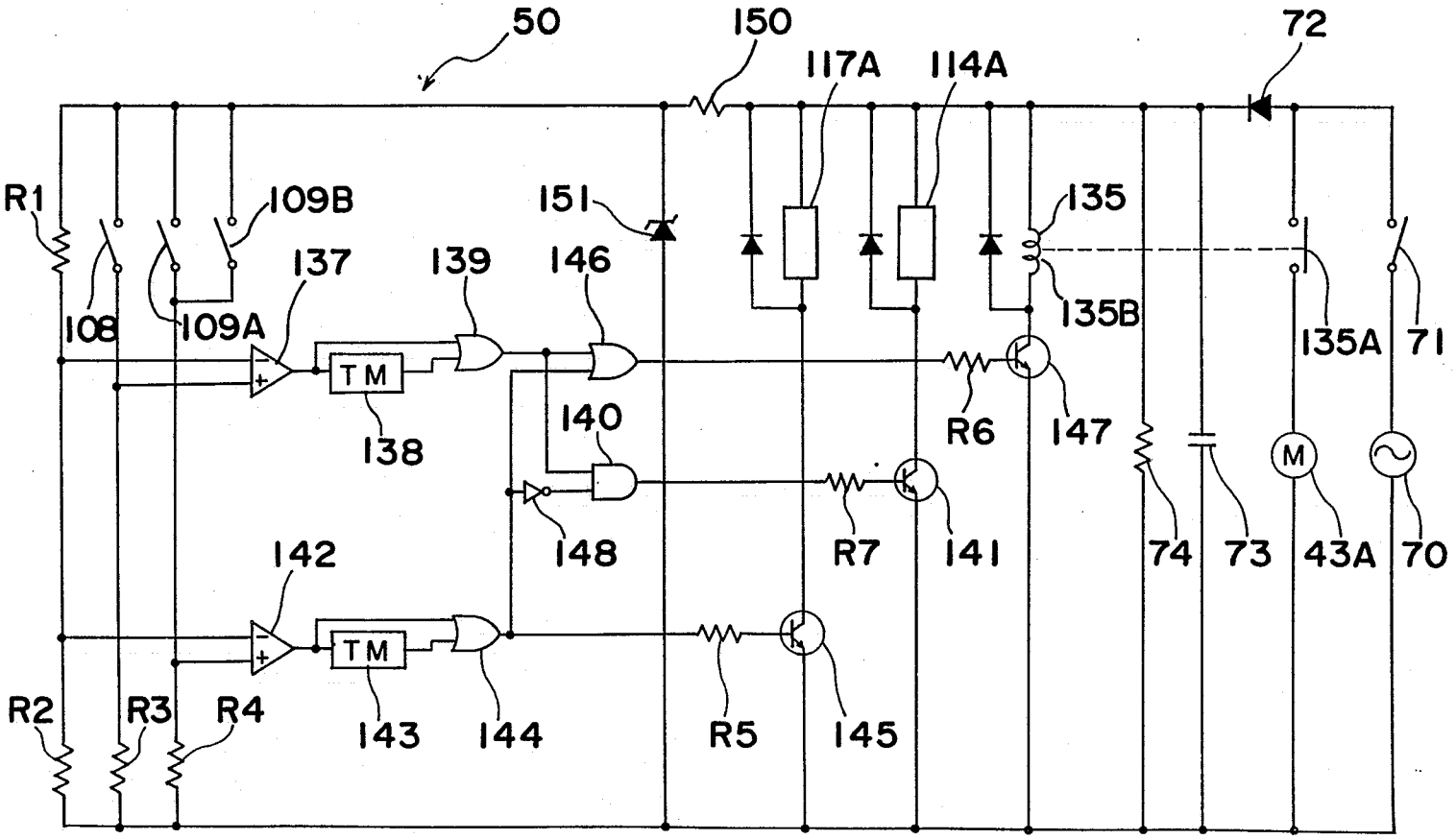
FIG. 13 is a circuit diagram of a control circuit employed in the shredder of FIG. 11.

Referring finally to FIGS. 11 to 13, there is shown a shredder K5 according to a fifth embodiment of the present invention. In the shredder K5, the first detection switch 108 of the shredder K4 is replaced by a paper sensor 108 and the second detection switch 109 of the shredder K4 is replaced by a pair of paper sensors 109A and 109B. Since some parts of the shredder K5 are similar to those of the shredder K4, detailed description thereof is abbreviated for the sake of brevity. Therefore, it is to be noted that FIG. 8 of the shredder K4 is likewise applicable to the shredder K5.

The control circuit 50 controls the first and second document feeding device 107A and 107B on the basis of detection signals from the paper sensor 108 and the paper sensors 109A and 109B, respectively. The control device 50 includes a priority processing means 50A for outputting a stop signal to the first document feeding device 107A and a drive signal to the second document feeding device 107B in response to a signal representing presence of the documents in the second document feeding portion 45 and a priority processing holding means 50B for outputting a signal for prohibiting redriving of the first document feeding device 107A until a predetermined time period elapses after output of a signal representing absence of the documents in the second document feeding portion 45.

The first document feeding device 107A includes rollers 114 and 115 for feeding to the upper and lower cutter rollers 31 and 32 the documents loaded into the first document feeding portion 44, a transport belt 116 wound around the rollers 114 and 115, a motor 43A for driving the rollers 114 and 115 and a first clutch 114A of electromagnetic type for transmitting a driving force of the motor 43A to the rollers 114 and 115.

The second document feeding device 107B includes rollers 117 and 118 for feeding to the upper and lower cutter rollers 31 and 32 the documents loaded into the second document feeding portion 45, a transport belt 119 wound around the rollers 117 and 118, the motor 43A for driving the rollers 117 and 118 and a second clutch 117A of electromagnetic type for transmitting to the driving force of the motor 43A to the rollers 117 and 118.

The document shredding portion 3 includes upper and lower cutter rollers 31 and 32 and the motor 43A functioning as the drive unit 43. The motor 43A is also used for the first and second document feeding devices 107A and 107B. The upper and lower cutter rollers 31 and 32 have the shredding capability of about 22 documents of 50 $g/m^2$.

In the first document feeding portion 44, a predetermined quantity of the documents can be transported sequentially from a lower portion thereof towards the upper and lower cutter rollers 31 and 32 by the transport belt 116 and the counterrotating roller 106A. The quantity of the documents transported from the first document feeding portion 44 to the upper and lower cutter rollers 31 and 32 is adjusted in accordance with the shredding capability of the upper and lower cutter rollers 31 and 32. In this embodiment, the transport belt 116 and the counterrotating roller 106A are spaced a distance so as to allow a maximum of 20 documents to pass therethrough.

In the second document feeding portion 45, a predetermined number of documents can be transported towards the upper and lower cutter rollers 31 and 32 by the transport belt 119 and the counterrotating roller 106B. The number of the documents transported from the second document feeding portion 45 to the upper and lower cutter rollers 31 and 32 is adjusted in accordance with the shredding capability of the upper and lower cutter rollers 31 and 32. In this embodiment, the transport belt 119 and the counterrotating roller 106B are spaced apart a distance so as to allow a maximum of 20 documents to pass therethrough. However, the numbers of documents fed from the second document feeding portion 45 to the upper and lower cutter rollers 31 and 32 may be set to an arbitrary value not more than the shredding capability of the upper and lower cutter rollers 31 and 32.

A detection switch functioning as the paper sensor 108 for detecting presence and absence of the documents in the first document feeding portion 44 is so provided as to project upwardly from the transport belt 116. Meanwhile, detection switches functioning as the paper sensors 109A and 109B for detecting presence and absence of the documents in the second document feeding portion 45 are provided along the feeding direction of the documents so as to project upwardly from the transport belt 119.

As shown in FIG. 13, the control circuit 50 includes the AC power source 70, the power source switch 71, the diode 72, the capacitor 73 and the resistor 74. The rectification filter circuit formed by the diode 72, the capacitor 73 and the resistor 74 is connected, through the power source switch 71, to the AC power source 70. A relay 135 and the first and second clutches 114A and 117A, which are turned on and off in response to the turning on and off of the paper sensors 108, 109A and 109B, are connected to the rectification filter circuit. A normally open relay contact 135A of the relay 135 is connected in series to the motor 43A.

The circuit for performing on-off control of the first clutch 114A comprises a first comparator 137, a first timer circuit 138, a first OR logic circuit 139, an AND logic circuit 140 for priority processing and a first transistor 141.

Meanwhile, the circuit for performing on-off control of the second clutch 117A comprises a second comparator 142, a second timer circuit 143, a second 0R logic circuit 144 and a second transistor 145.

Furthermore, the circuit for performing on-off control of the relay 135 comprises an OR logic circuit 146, a transistor 147 for shredding, etc.

The minus (−) input terminal of the first comparator 137 is connected to the junction of resistors R1 and R2, while the plus (+) input terminal of the first comparator 137 is connected to the junction of the paper sensor 108 for the first document feeding portion 44 and a resistor R3. The output terminal of the first comparator 137 is connected to the input terminal of the first timer circuit 138 and one input terminal of the first OR logic circuit 139 and the output terminal of the first timer circuit 138 is connected to the other input terminal of the first 0R logic circuit 139. The output terminal of the first OR logic circuit 139 is connected to one input terminal of the OR logic circuit 146 and one input terminal of the AND circuit 140 for priority processing.

The minus (−) input terminal of the second comparator 142 is connected to the junction of the resistors R1 and R2, while the plus (+) input terminal of the second comparator 142 is connected to the junction of a parallel connection of the paper sensors 109A and 109B for the second document feeding portion 45 and a resistor R4. The output terminal of the second comparator 142 is connected to the input terminal of the second timer circuit 143 and one input terminal of the second OR logic circuit 144. The output terminal of the second timer circuit 143 is connected to the other input terminal of the second OR logic circuit 144. The output terminal of the second OR logic circuit 144 is connected to the other input terminal of the OR logic circuit 146 and is connected, through a resistor R5, to the base of the second transistor 145. The output terminal of the second OR logic circuit 144 is also connected, via an inverter 148, to the other input terminal of the AND logic circuit 140 for priority processing.

The output terminal of the OR logic circuit 146 is connected, by way of a resistor R6, to the base of the transistor 147 for shredding. Meanwhile, the output terminal of the AND logic circuit 140 for priority processing is connected, through a resistor R7, to the base of the first transistor 141.

The first timer circuit 138 is adapted to output a high logic level signal for a predetermined time period of, for example, 4 seconds after step down of the output signal of the first comparator 137 from a high level to a low logic level so as to generate a low level signal 4 seconds after the step down. Likewise, the second timer circuit 143 is adapted to output a high level signal for a predetermined time period of, for example, 7 seconds after step down of the output signal of the second comparator 142 from a high level to a low level so as to generate the low level signal 7 seconds after the step down.

By the above described configuration of the control circuit 50, when the power source switch 71 is closed, a DC voltage is generated by the diode 72, the capacitor 73 and the resistor 74. When documents to be discarded are loaded into the first document feeding portion 44, the detection switch 108 is closed and thus, the output of the first comparator 137 is set to a high level. When the documents to be discarded are loaded into the second document feeding portion 45, the detection switch 109A or 109B is closed and thus, the output of the second comparator 142 is set to high level. It is to be noted that the two detection switches 109A and 109B are provided in view of the rather long distance from the second document feeding portion 45 to the upper and lower cutter rollers 31 and 32. The output of the first comparator 137 is applied to the first OR logic circuit 139 and the first timer circuit 138. The first OR logic circuit 139 outputs the high level signal when the detection switch 108 is closed and during 4 seconds after turning off of the detection switch 108. Similarly, the second OR logic circuit 144 outputs a high level signal when the detection switch 109A or 109B is closed or during 7 seconds after the turning off of the detection switch 109A or 109B.

When documents are loaded into either of the first and second document feeding portions 44 and 45, the detection switch 108 or the detection switches 109A and 109B are turned on. Therefore, when the first OR logic circuit 139 or the second OR logic circuit 144 is turned on, so that the OR logic circuit 146 is also turned on and thus, the transistor 147 for shredding is turned on. Hence, electric current flows through a coil 135B of the relay 135, so that the normally open relay contact 135A is closed and thus, motor 43A is driven so as to rotate the upper and lower cutter rollers 31 and 32.

When the documents are loaded into only the first document feeding portion 44, a high level signal is generated by the first comparator 137 and a low level signal is generated from the second comparator 142. Therefore, the output of the AND logic circuit 140 for priority processing is set to a high level by the inverter 148 and thus, the first transistor 141 is turned on. Hence, the first clutch 114A is turned on so as to transmit the rotational force of the motor 43A to the transport belt 116 and the counterrotating roller 106A.

When documents are present at only the second document feeding portion 45, only the second transistor 145 and the transistor 147 for shredding are turned on and thus, the second clutch 117A is turned on.

Then, when documents are present at the first and second document feeding portions 44 and 45, the AND logic circuit 140 for priority processing is set to a low level by the inverter 148, whereupon the first transistor 141 is turned off, the first clutch 114A is turned off. Hence, the transport belt 116 for the first document feeding portion 44 stops. On the other hand, the second transistor 145 is in an ON state. Therefore, the second clutch 117A for the second document feeding portion 45 is turned on so as to transmit the rotational force of the motor 43A to the transport belt 119 and the counterrotating roller 106B. Subsequently, when shredding of the documents from the second document feeding portion 45 has been completed, the detection switches 109A and 109B are turned off. Therefore, the output of the second OR logic circuit 144 is set to the low level, so that the output of the AND logic circuit 140 for priority processing is set to a high level and thus, the first clutch 114A for the first document feeding portion 44 is turned on so as to resume transport of the documents of the first document feeding portion 44.

Meanwhile, in the case of the first document feeding portion 44, the motor 43A and the first document feeding device 107A are actuated for 4 seconds after turning off of the detection switch 108. Since this duration of 4 seconds is sufficiently long for allowing a document to pass through the upper and lower cutter rollers 31 and 32 after the trailing edge of the document has passed through the detection switch 108, the trailing edge of the document can also be shredded completely.

On the other hand, in the case of the second document feeding portion 45, the motor 43A and the second document feeding device 107B are actuated for 7 seconds after turning off of the detection switches 109A and 109B. This duration of 7 seconds for the second document feeding portion 45 is longer than the duration of 4 seconds for the first document feeding portion 44 because feeding of documents from the first document feeding portion 44 should not be started in the case where documents are loaded into the second document feeding portion 45 intermittently.

Figure 14A:
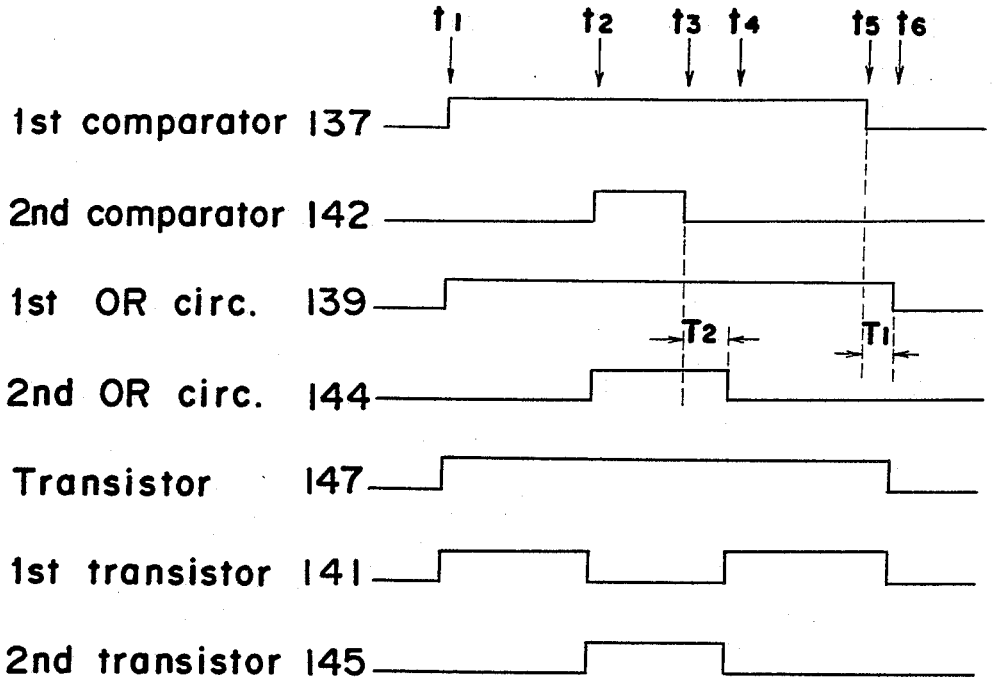
FIGS. 14A and 14B are time charts showing operation of the control circuit of FIG. 13.
Figure 14B:
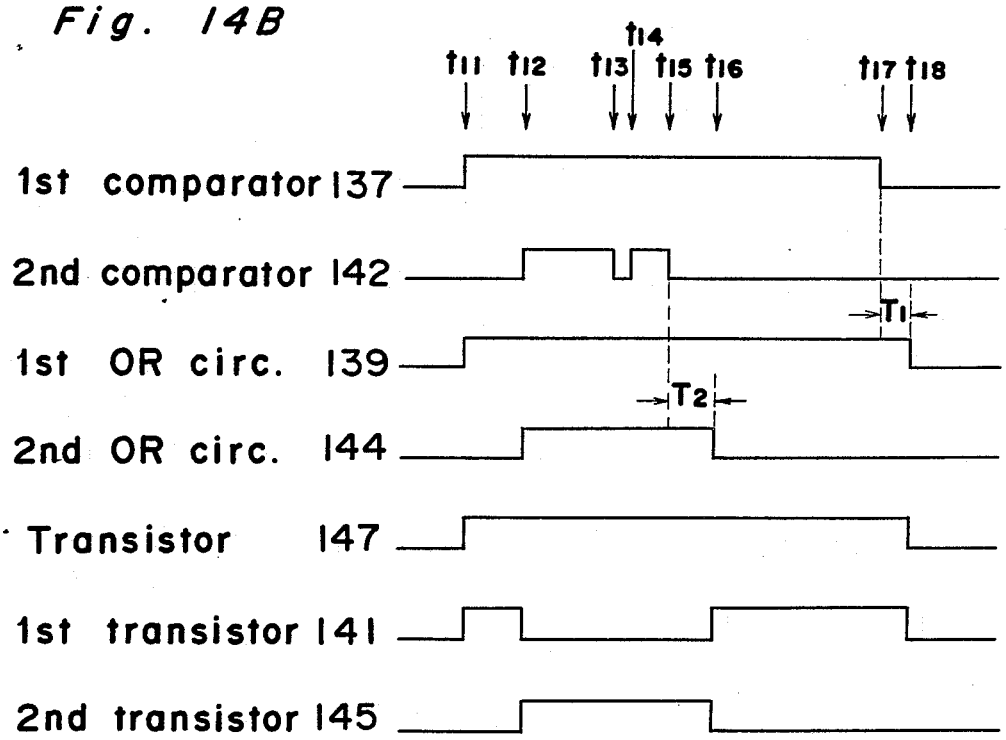

FIGS. 14A and 14B are time charts showing operation of the control circuit 50. In FIG. 14A, documents to be discarded are loaded into the first document feeding portion 44 at a time t1 and are shredded. When documents to be discarded are loaded into the second document feeding portion 45 at a time t2, operation of the first document feeding portion 44 is stopped. Subsequently, when at a time t3, both of the detection switches 109A and 109B are turned off, wherein documents are absent in the second document feeding portion 45, feeding of documents from the first document feeding portion 44 is resumed at a time t4. Then, at a time t5, the detection switch 108 is turned off, wherein documents are absent in the first document feeding portion 44. Finally, at a time t6, rotation of the motor 43A stops. A duration T2 from the time t3 to the time t4 is set to the preset time period of the second timer circuit 143, i.e. about 7 seconds. Meanwhile, a duration T1 from the time t5 to the time t6 is set to the preset time period of the first timer circuit 138, i.e. about 4 seconds.

In FIG. 14B, documents are loaded into the first document feeding portion 44 at a time t11. When the documents are loaded into the second document feeding portion 45 at a time t12, feeding of the documents from the first document feeding portion 44 is suspended. Then, at a time t13, both of the detection switches 109A and 109B are turned off, wherein the documents are absent in the second document feeding portion 45. Subsequently, if the documents are loaded into the second document feeding portion 45 at a time t14 before lapse of the duration T2 after both of the detection switches 109A and 109B have been turned off at the time t13, both of the detection switches 109A and 109B are turned off, wherein documents are absent in the second document feeding portion 45 at a time t15. Then, at a time t16, i.e. upon lapse of the duration T2 from the time t15, feeding of the documents from the first document feeding portion 44 is resumed. Thereafter, at a time t17, the detection switch 108 is turned off, namely the documents are absent in the first document feeding portion 44. At a time t18, i.e. upon lapse of the duration T1 from the time t17, rotation of the motor 43A stops.

Accordingly, in the shredder K5, when the documents are loaded into the second document feeding device 45 having priority over the first document feeding portion 44, feeding of documents from the first document feeding portion 44 is suspended until the documents loaded into the second document feeding portion 45 have been shredded. Then, when documents from the second documents feeding portion 45 have been shredded, shredding of the documents from the first document feeding portion 44 is resumed.

Furthermore, in the case where the documents are loaded into the second document feeding portion 45 intermittently, feeding of the documents from the first document feeding portion 44 is not started if a time interval for loading the documents into the second document feeding portion 45 is not more than the duration T2, thereby resulting in a smooth transition in the shredding of documents from the second document feeding portion 45.

Meanwhile, because feeding of documents from the first document feeding portion 44, acting as a main document feeding portion, is not performed unless the duration T2 elapses after completion of shredding of the documents from the second document feeding portion 45 which has priority over the first document feeding portion 44, an undesirable phenomenon does not take place wherein the leading edges of the documents fed from the first document feeding portion 44 overlap the trailing edges of the last documents fed from the second document feeding portion 45. Therefore, it becomes possible to prevent documents exceeding the shredding capability of the upper and lower cutter rollers 31 and 32 from being fed in between the upper and lower cutter rollers 31 and 32.

As will be seen from the foregoing description, in the fifth embodiment of the present invention, when documents are loaded into the second document feeding portion 45, having priority over the first document feeding portion 44, feeding of documents from the first document feeding portion 44 is suspended such that the documents loaded into the second document feeding portion 45 are shredded by priority over the documents loaded into the first document feeding portion 44. Thus, when the documents from the second document feeding portion 45 have been shredded, shredding of the documents from the first document feeding portion 44 is resumed.

Furthermore, in the case where documents are loaded into the second document feeding portion 45 intermittently, shredding of the documents from the first document feeding portion 44 is not started if the time interval for loading the documents into the second document feeding portion 45 does not exceed the duration T2, thus resulting in smooth shredding of the documents from the second document feeding portion 45.

Moreover, since feeding of documents from the first document feeding portion 44 acting as the main document feeding portion is not performed unless the duration T2 elapses after completion of shredding of documents from the second document feeding portion 45 having priority over the first document feeding portion 44, the leading edges of the documents fed from the first document feeding portion 44 do not overlap the trailing edges of the last documents fed from the second document feeding portion 45. Therefore, a desirable effect is produced in that documents exceeding the shredding capability of the upper and lower cutter rollers 31 and 32 are prevented from being fed in between the upper and lower cutter rollers 31 and 32.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as being included therein.

What is claimed is:

1. A shredder for shredding documents, comprising:

cutting means for cutting said documents;

a first document feeding portion for feeding said documents to said cutting means;

a second document feeding portion for feeding said documents to said cutting means;

document transporting means located at said first document feeding portion for transporting said documents to said cutting means;

first document detecting means for detecting the presence of said documents in said first document feeding portion and generating an output signal indicate thereof ;

drive means for driving said document transporting means;

second document detecting means for detecting the presence of said documents in siad second document feeding portion and generating an output signal indicate thereof; and drive control means for controlling operation of said drive means in accordance with an output signal generated by said first document detecting means and an output signal generated by said second document detecting means, wherein said drive control means stops said drive means regardless of the output signal generated by said first document detecting means whenever said second document detecting means detects the presence of said documents in said second document feeding portion, and wherein said drive control means controls said drive means in accordance with the output signal generated by said first document detecting means whenever said second document detecting means does not detect the presence of said documents in said second document feeding portion.

2. The shredder as claimed in claim 1, wherein said drive control means inhibits operation of said document transporting means regardless of the output signal generated by said first document detecting means until a predetermined time period has elapsed following the absence of said documents in said second document feeding portion being detected by said second document detecting means.

3. The shredder as claimed in claim 1, and further comprising:

second document transport means located at said second document feeding portion for transporting the documents to said cutting means.

* * * * *